US007175186B2

(12) United States Patent
Lin

(10) Patent No.: US 7,175,186 B2
(45) Date of Patent: Feb. 13, 2007

(54) SKATE WITH AN ADJUSTABLE SOLE PLATE

(76) Inventor: Henkel Lin, No. 13, Lane 130, Kung-An Rd., Houli Hsiang, Taichung Hsien (TW)

( * ) Notice: Subject to any disclaimer, the term of this patent is extended or adjusted under 35 U.S.C. 154(b) by 289 days.

(21) Appl. No.: 10/966,179

(22) Filed: Oct. 15, 2004

(65) Prior Publication Data

US 2006/0091621 A1 May 4, 2006

(51) Int. Cl.
*A63C 1/26* (2006.01)

(52) U.S. Cl. ..... 280/11.26; 280/11.27

(58) Field of Classification Search ..... 280/11.26, 280/11.221, 11.223, 11.27, 11.16; 36/97
See application file for complete search history.

(56) References Cited

U.S. PATENT DOCUMENTS 5,484,149 A * 1/1996 Lee ..... 280/11.26
6,045,144 A * 4/2000 Wong ..... 280/11.26
6,276,697 B1 * 8/2001 Lin ..... 280/11.26
6,308,965 B1 * 10/2001 Yang ..... 280/11.221
6,450,510 B1 * 9/2002 Liu ..... 280/11.26
6,547,261 B2 * 4/2003 Gorza et al. ..... 280/11.223
6,612,592 B1 * 9/2003 Soo ..... 280/11.16
6,669,210 B2 * 12/2003 Chen ..... 280/11.16
6,918,601 B2 * 7/2005 Sauter et al. ..... 280/11.26
6,918,602 B2 * 7/2005 Lu ..... 280/11.26
6,983,942 B2 * 1/2006 Chen ..... 280/11.26

* cited by examiner

*Primary Examiner*—Jeff Restifo
(74) *Attorney, Agent, or Firm*—Alan D. Kamrath; Nikolai & Mersereau, P.A.

(57) ABSTRACT

A skate with an adjustable sole plate has a sole plate and a boot mounted on the sole plate. The sole plate has a front body and a rear body. The front body has a locking element mounted on the front body, and the rear body of the sole plate has at least one key formed on the rear body. The key comprises multiple transverse locking holes/slots defined in the key to correspond to different lengths. A person can adjust the length of the sole plate by inserting the locking element of the front body into different transverse locking holes, transverse slots or both.

4 Claims, 7 Drawing Sheets

SKATE WITH AN ADJUSTABLE SOLE PLATE

BACKGROUND OF THE INVENTION

1. Field of Invention

The present invention relates to a skate, and more particularly to a skate with an adjustable sole plate.

2. Description of the Related Art

Conventional skates have rollers or blades to increase the speed and versatility of the skates. The conventional skate has a boot, a sole plate mounted on the boot and a roller or blade assembly mounted on the sole plate. Most types of skates are a fixed length and width and cannot be adjusted to the sizes of different people's feet, so children need to obtain new skates as their feet grow. The fixed length also necessitates the production of many different sizes. Consequently, the quantity of skates in any given production run is limited. To solve such problems, skates with adjustable sole plates exist. However, the elements of such adjustable sole plates of skates are complex and hard to use. Furthermore, such adjustable sole plates often injure people's fingers.

The present invention provides a skate to mitigate or obviate the aforementioned problems.

SUMMARY OF THE INVENTION

The primary objective of the present invention is to provide a skate with an adjustable sole plate.

A skate with an adjustable sole plate has a sole plate and a boot mounted on the sole plate. The sole plate has a front body and a rear body. The front body has a locking element mounted on the front body, and the rear body of the sole plate has at least one key formed on the rear body. The key comprises multiple transverse locking holes, locking slots or both defined in the key to correspond to different lengths. A person can adjust the length of the sole plate by inserting the locking element of the front body into different transverse locking holes, transverse slots or both.

Other objectives, advantages and novel features of the invention will become more apparent from the following detailed description when taken in conjunction with the accompanying drawings.

DETAILED DESCRIPTION OF THE INVENTION

Figure 1:
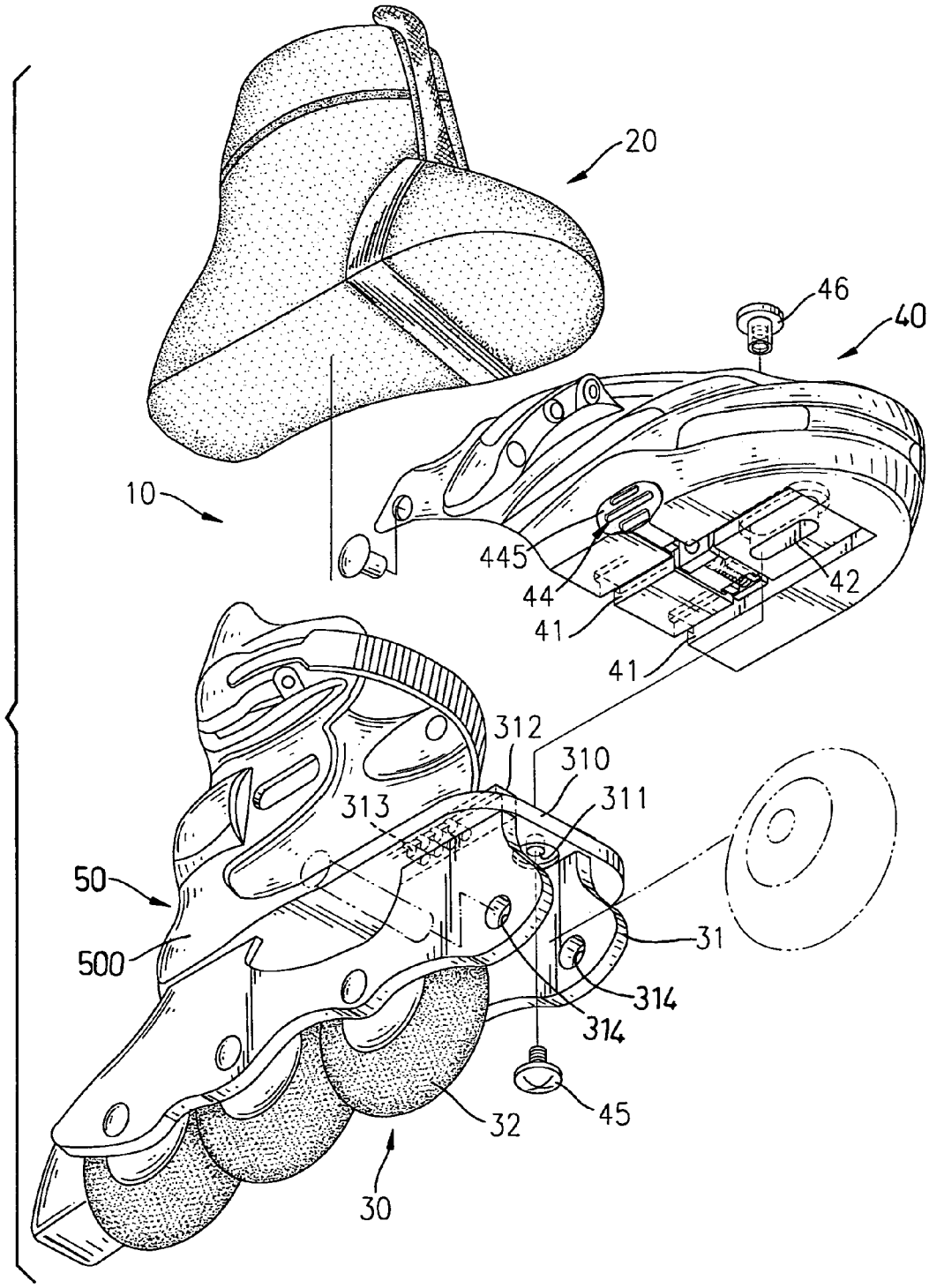
FIG. 1 is an exploded perspective view of a skate with an adjustable sole plate in accordance with the present invention.
Figure 2:
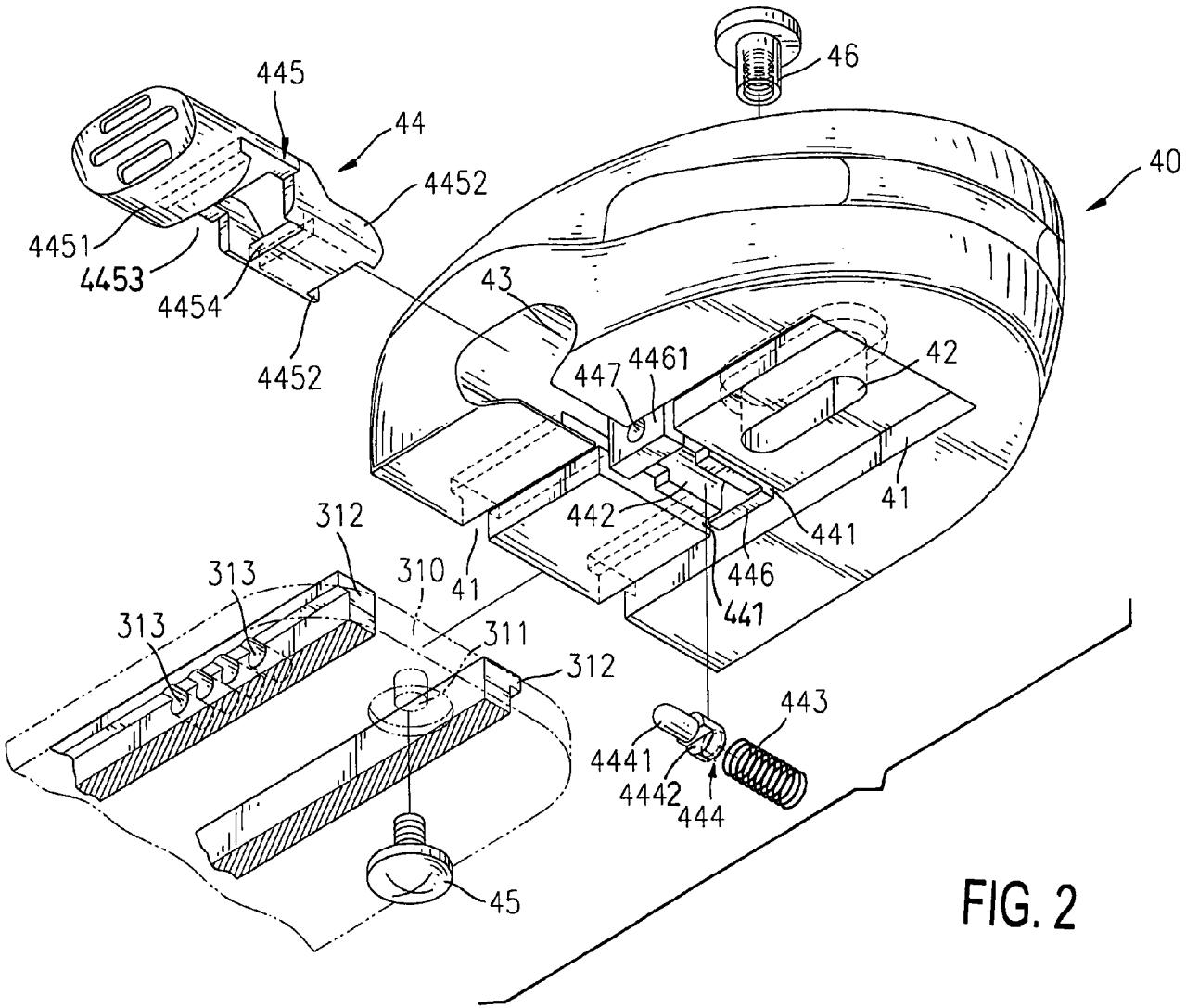
FIG. 2 is an enlarged exploded perspective view of the joint of the adjustable sole plate in FIG. 1.

With reference to FIGS. 1 and 2, a skate with an adjustable sole plate in accordance with the present invention has a sole plate (10) and a boot (20) mounted on the sole plate (10).

The sole plate (10) has a front body (40) and a rear body (50).

The rear body (50) is attached to the front body (40) and has a front end, a bottom, a blade assembly (30) and a bracket (500). The blade assembly (30) is mounted on the bottom of the rear body (50) and has a blade device. Preferably, the blade device is multiple rollers (32) or a sharp-edged blade. The bracket (500) is mounted on the bottom of the rear body (50) and has a bottom, two side edges, a baseplate (310), at least one key (312), multiple transverse locking holes (313), a locking hole (311) and two optional wings (31). The baseplate (310) is formed at the bottom of the bracket (500) and has a top surface and a bottom surface. The at least one key (312) is formed on the top surface of the baseplate (310). In a preferred embodiment, the key (312) is an inverted L-shape and has a longitudinal leg and a transverse sliding foot. The longitudinal leg extends perpendicular from the baseplate (310) and has a distal end. The transverse sliding foot is formed on the distal end of the longitudinal leg. In a preferred embodiment, two keys (312) are formed on the top surface of the baseplate (310). The transverse locking holes (313) are defined through one of the keys (312). In a preferred embodiment, the transverse locking holes (313) are defined through the longitudinal leg of one of the keys (312). The locking hole (311) is defined through the baseplate (310) near the front end of the rear body (50). The wings (31) extend perpendicular from the bottom surface of the baseplate (310) at the side edges of the bracket (500), and the wings (31) have multiple through holes (314) defined in the wings (31). The through holes (314) in one wing (31) align with the through holes (314) in the other wing (31). The blade device is mounted between the wings (31).

The front body (40) has a front end, a rear end, a bottom, a side surface, at least one keyway (41), a longitudinal slot (42), a connector, a transverse recess (43), a cavity (442), two optional guide slots (441) and a locking element (44).

The keyway (41) is defined in the bottom of the front body (40) and slidably holds the key (312). A keyway (41) corresponds to each key (312) on the baseplate (310). In a preferred embodiment, two keyways (41) are defined in the bottom of the front body (40) and are L-shaped to correspond to the keys (312).

The longitudinal slot (42) is defined in the bottom of the front body (40) near the front end. When the front body (40) is connected to the rear body (50), the longitudinal slot (42) aligns with the locking hole (311) in the baseplate (310).

The connector is mounted in the longitudinal slot (42) and the locking hole (311) to connect the baseplate (310) to the front body (40). In a preferred embodiment, the connector is a nut (46) and a screw (45).

The transverse recess (43) is defined in the side surface of the front body (40), communicates with one of the keyways (41) and has an inner end, an outer end and an inner surface.

The cavity (442) is defined in the bottom of the front body, is aligned with the transverse recess (43) and has a front side, a rear side, an exterior end (446) and an interior end (4461). The interior end (4461) has a through hole (447).

The guide slots (441) are defined in the bottom of the front body (40) respectively outside the front side and rear side of the cavity (442) and communicate with the keyways (41).

Figure 3:
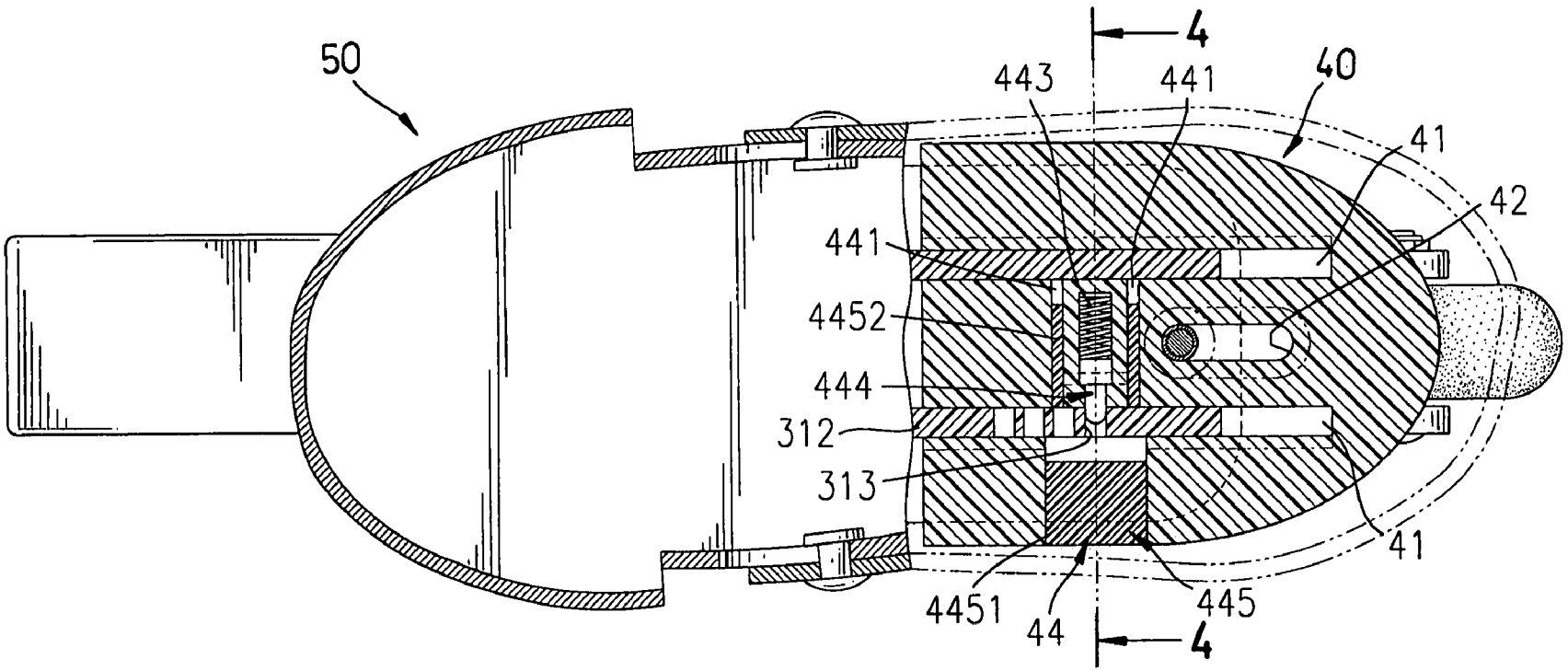
FIG. 3 is a top view in partial section of the skate with an adjustable sole plate in FIG. 1 with the sole plate adjusted to the longest size.
Figure 4:
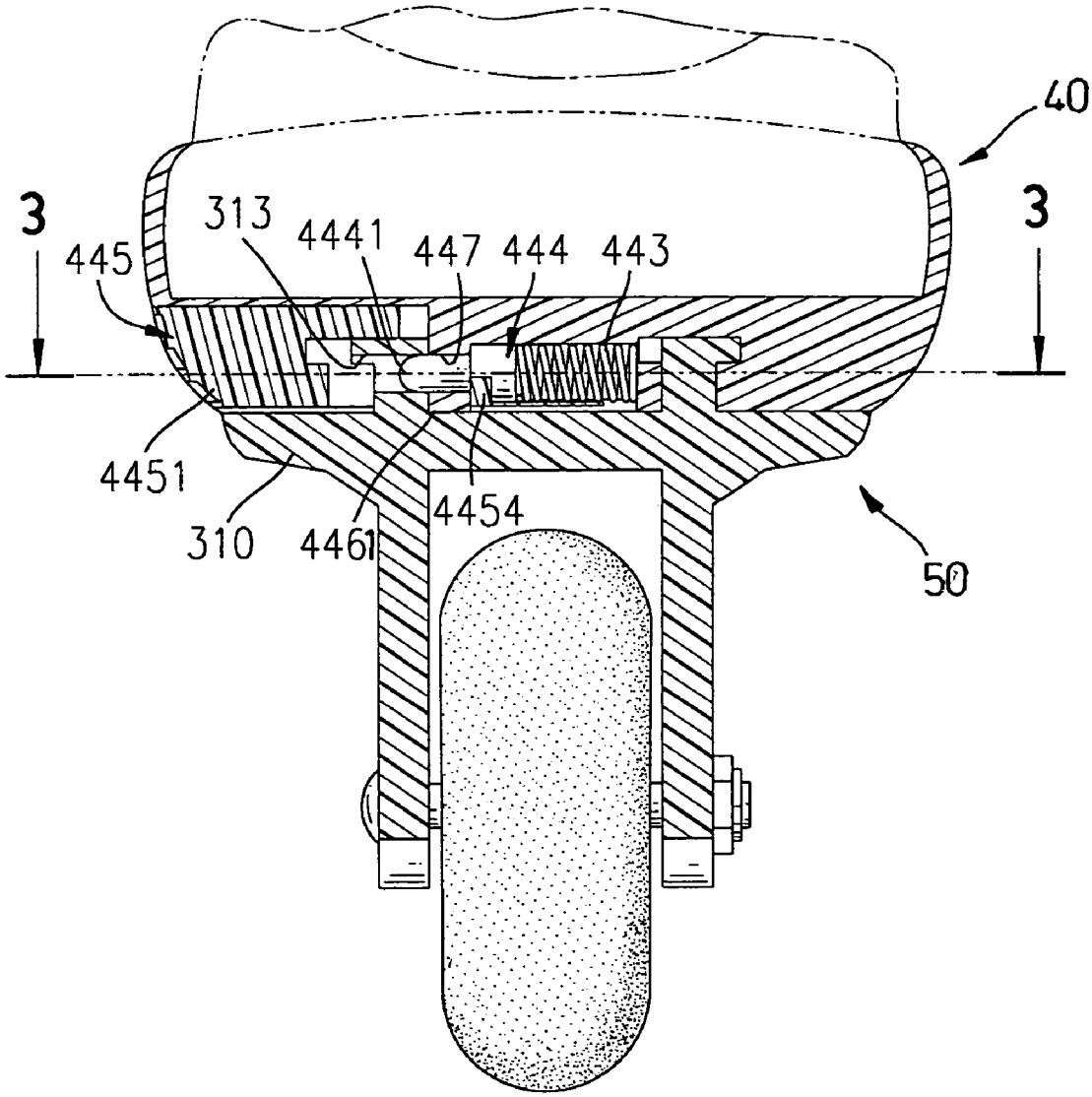
FIG. 4 is a front view in partial section of the skate with an adjustable sole plate in FIG. 1.

With further reference to FIGS. 3 and 4, the locking element (44) is mounted in the transverse recess (43), the guide slots (441) and the cavity (442) and has a pushing body (445) and a bolt assembly (444).

The pushing body (445) is mounted slidably inside the transverse recess (43) and has an inner end, an outer end, a top, a bottom, two sides, a pushing button (4451), two optional tabs (4452), a key recess (4453) and a lip (4454). The pushing button (4451) is formed at the outer end of the pushing body (445), and the two tabs (4452) are formed on the sides of the pushing body (445) at the inner end. The key recess (4453) is defined in the bottom of the pushing body (445) and communicates with the keyway (41) when the locking element (44) is mounted inside the transverse recess (43). The lip (4454) is formed on the top of the pushing body (445).

The bolt assembly (444) is mounted inside the cavity (442) in the front body (40) and has a bolt (4441) and a spring (443). The bolt (4441) has a front end, a middle, a rear end and a locking shoulder (4442). The locking shoulder (4442) is defined in the middle of the bolt (4441). When the pushing body (445) is mounted inside the transverse recess (43), the lip (4454) engages the locking shoulder (4442) on the bolt (4441), and the front end of the bolt (4441) selectively protruding through the through hole (447) in the interior sidewall (4461). The spring (443) has two ends and is mounted between the rear end of the bolt (4441) and the exterior sidewall (446).

Figure 5:
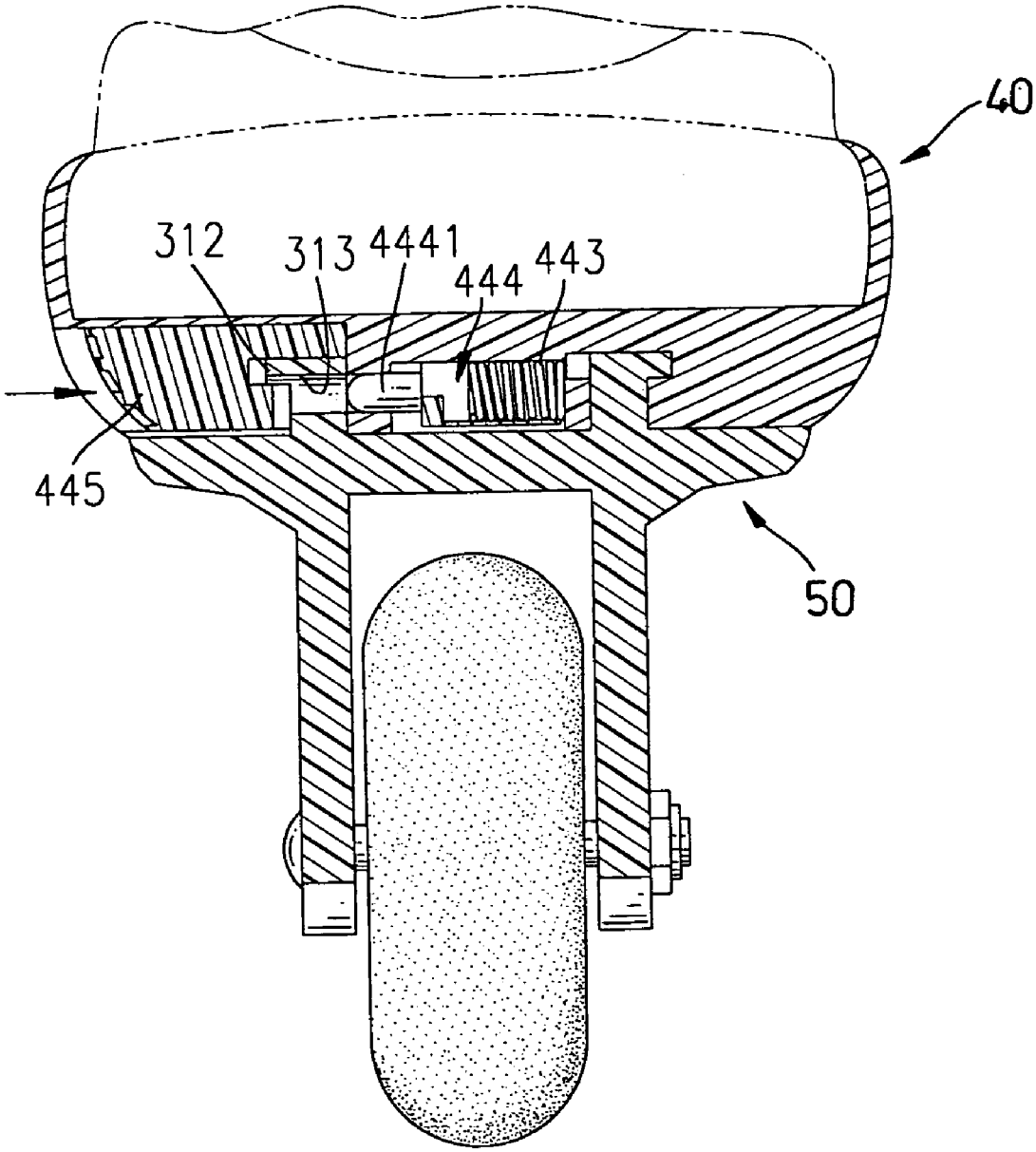
FIG. 5 is a front view in partial section of the skate with an adjustable sole plate in FIG. 1 with a locking element pushed.
Figure 6:
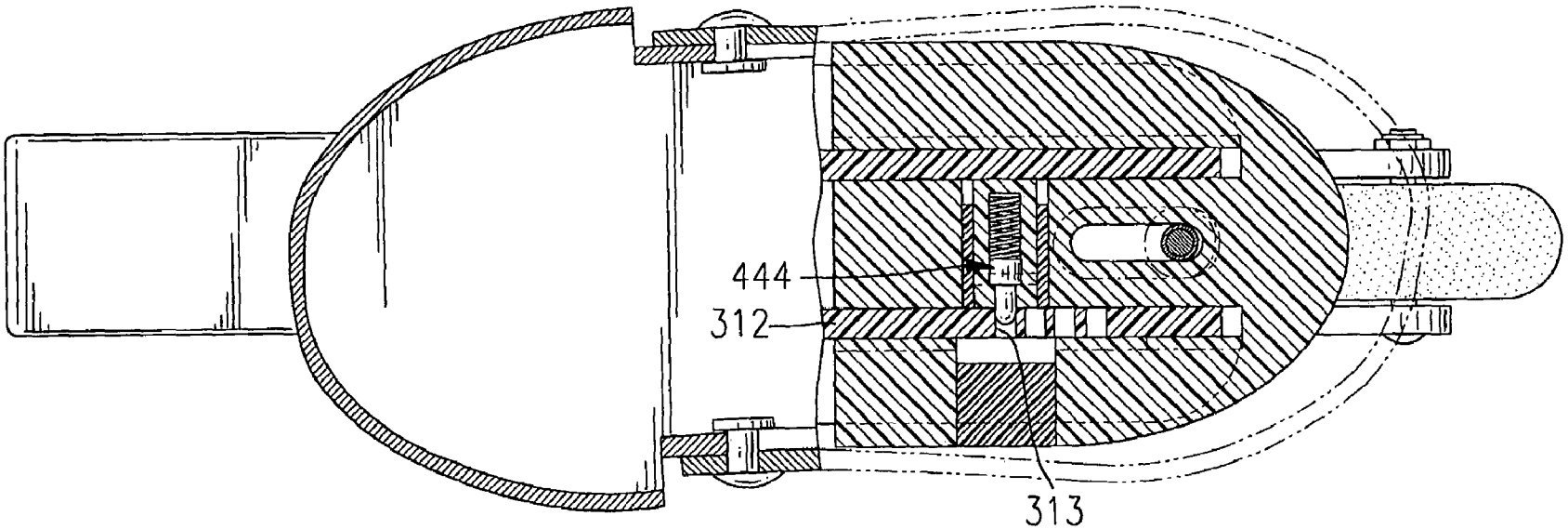
FIG. 6 is a top view of the skate with an adjustable sole plate in FIG. 1 with the sole plate adjusted to the shortest size.

With reference to FIGS. 4 to 6, when the pushing body (445) is pushed, the bolt (4441) of the bolt assembly (444) is pushed back by the lip (4454) of the pushing body (445) into the through hole (447) in the interior sidewall (4461) and disengages from the transverse locking hole (313) in the key (312). Then the keys (312) of the rear body (50) can move inside the keyways (41) in the front body (40). When the pushing body (445) is released, the bolt (4441) extends from the through hole (447) in the interior sidewall (4461) and engages one of the transverse locking holes (313) in the key (312) on the rear body (50). Because the bolt (4441) can engage different transverse locking holes (313) in the key (312) of the rear body (50), the length of the sole plate (10) can be adjusted.

Figure 7:
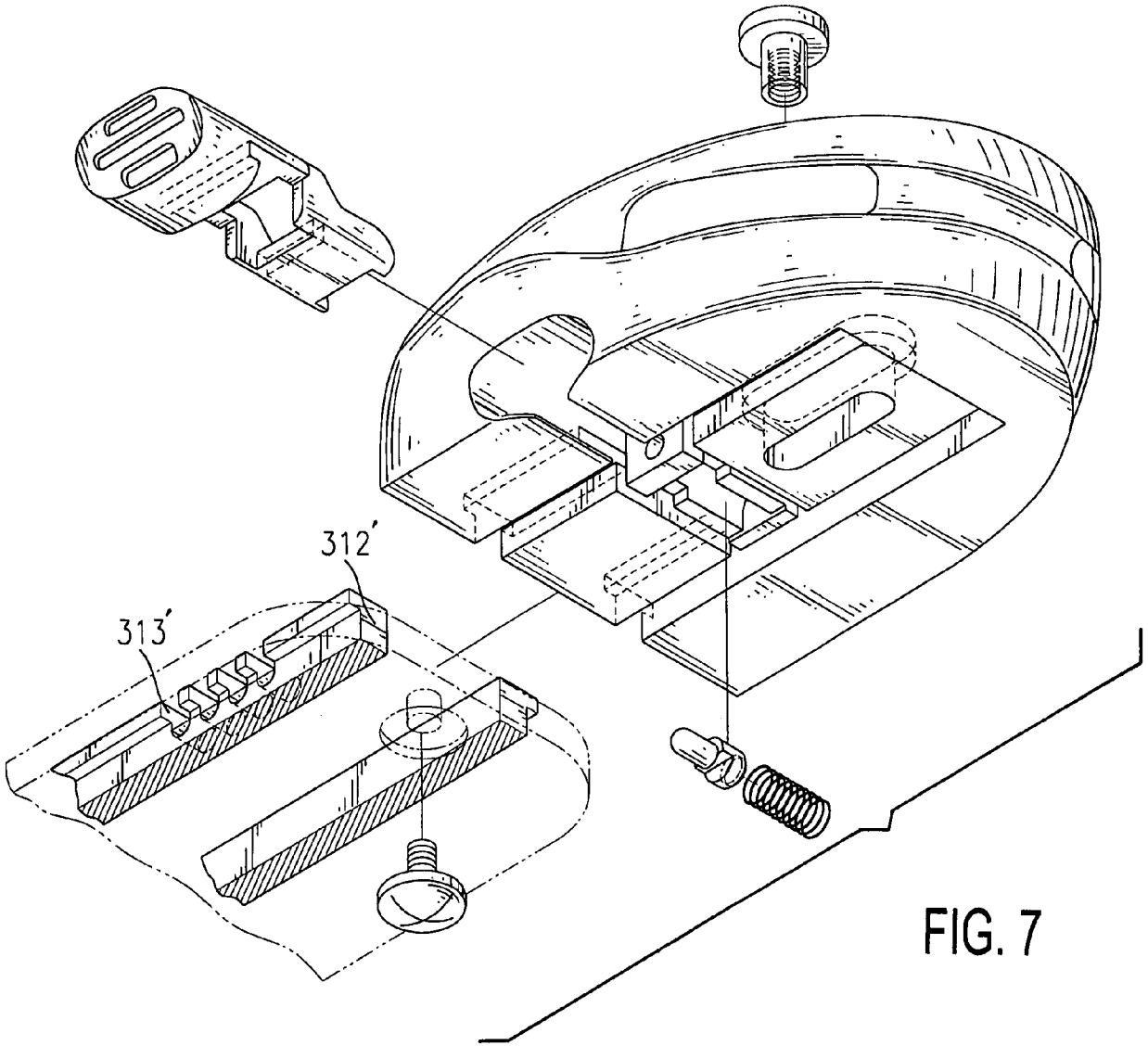
FIG. 7 is an enlarged exploded perspective view of a second embodiment of the adjustable sole plate in accordance with the present invention.

With reference to FIG. 7, a second embodiment of the skate with an adjustable sole plate has locking holes (313) can be formed as locking slots (313') that the bolt (4441) selectively engages.

The advantages of the skate with an adjustable sole plate in accordance with the present invention are described as follows.

1. When the skate with an adjustable sole plate in accordance with the present invention is used, a user only needs to push the pushing button to adjust the length of the sole plate of a skate. Consequently, the present invention provides an easy way to adjust the length of the sole plate of the skate.

2. Because the skate with an adjustable sole plate is adjusted by pushing the pushing button, a user will not easily injure his or her fingers.

3. The locking elements of the skate with an adjustable sole plate are simple, so the adjustable sole plate of a skate can be repaired easily.

The invention may be varied in many ways by a person skilled in the art. Such variations are not to be regarded as a departure from the spirit and scope of the invention, and all such modifications are intended to be included within the scope of the following claims.

What is claimed is:

1. A skate with an adjustable sole plate, comprising
- a sole plate having
- a rear body having
  - a front end,
  - a bottom,
  - a blade assembly mounted on the bottom of the rear body and having a blade device, and
  - a bracket mounted on the bottom of the rear body, having
    - a bottom,
    - two side edges,
    - a baseplate formed at the bottom of the bracket and having
      - a top surface, and
      - a bottom surface,
      - at least one key formed on the top surface of the baseplate,
    - multiple transverse locking holes defined through one of the keys, and
    - a locking hole defined through the baseplate near the front end of the rear body,
- a front body attached to the rear body having
  - a front end,
  - a rear end,
  - a bottom,
  - a side surface,
  - at least one keyway defined in the bottom of the front body, slidably holding and corresponding to the at least one key on the baseplate,
  - a longitudinal slot defined in the bottom of the front body near the front end and aligning with the locking hole in the baseplate,
  - a connector mounted in the longitudinal slot in the front body and the locking hole in the rear body,
  - a transverse recess defined in the side surface of the front body and communicating with one of the at least one keyway, having
    - an inner end,
    - an outer end, and
    - an inner surface,
  - a cavity defined in the bottom of the front body, aligned with the transverse recess and having
    - a front side,
    - a rear side,
    - an exterior end, and
    - an interior end having a through hole, and
  - a locking element mounted in the transverse recess and the cavity and having
    - a pushing body mounted slidably inside the transverse recess having
      - an inner end,
      - an outer end,
      - a top,
      - a bottom,
      - two sides,
      - a pushing button formed at the outer end of the pushing body,
      - a key recess defined in the bottom of the pushing body and communicating with one of the at least keyway when the locking element mounted inside the transverse recess, and
      - a lip formed on the top of the pushing body, and a bolt assembly mounted inside the cavity of the front body and having a bolt having a front end selectively protruding through the through hole in the interior sidewall, a middle, a rear end, and a locking shoulder defined in the middle of the bolt and engaged by the lip on the pushing body, and a spring having two ends and mounted between the rear end of the bolt and the exterior sidewall, and a boot mounted on the sole plate.

2. The skate with an adjustable sole plate as claimed in claim 1, wherein the front body further comprises two guide slots defined in the bottom of the front body respectively outside the front side and rear side of the cavity and communicating with the at least one keyway in the front body, the locking element is further mounted in the guide slots, and the pushing body further comprises two tabs formed at the two sides for inserting into the guide slots.

3. The skate with an adjustable sole plate as claimed in claim 2, wherein two keyways are defined in the front body, and two keys are formed on the top surface of the baseplate of the rear body.

4. The skate with an adjustable sole plate as claimed in claim 1, wherein each one of the at least one key is an inverted L-shape and has a longitudinal leg extending perpendicular from the baseplate and having a distal end, and a transverse sliding foot formed on the distal end of the longitudinal leg.

* * * * *